US008302415B2

(12) United States Patent
Thybo et al.

(10) Patent No.: US 8,302,415 B2
(45) Date of Patent: Nov. 6, 2012

(54) METHOD FOR CONTROLLING A REFRIGERATION SYSTEM

(75) Inventors: Claus Thybo, Soenderborg (DK); Ole Ploug, Roedekro (DK)

(73) Assignee: Danfoss A/S, Nordborg (DK)

( * ) Notice: Subject to any disclaimer, the term of this patent is extended or adjusted under 35 U.S.C. 154(b) by 911 days.

(21) Appl. No.: 11/908,823

(22) PCT Filed: Mar. 15, 2006

(86) PCT No.: PCT/DK2006/000149

§ 371 (c)(1),
(2), (4) Date: May 2, 2008

(87) PCT Pub. No.: WO2006/097106

PCT Pub. Date: Sep. 21, 2006

(65) Prior Publication Data

US 2008/0276636 A1 Nov. 13, 2008

(30) Foreign Application Priority Data

Mar. 18, 2005 (DK) ..... 2005 00411

(51) Int. Cl.
*F25B 1/00* (2006.01)
*F25B 49/00* (2006.01)

(52) U.S. Cl. ..... 62/228.3; 62/200; 62/222; 62/224; 62/225; 62/226

(58) Field of Classification Search ..... 62/191, 62/200, 222, 224, 225, 226, 228.5
See application file for complete search history.

(56) References Cited

U.S. PATENT DOCUMENTS

| | | | | |
|---|---|---|---|---|
| 4,723,416 | A * | 2/1988 | Suzuki | 62/226 |
| 4,825,662 | A | 5/1989 | Alsenz | |
| 5,131,237 | A | 7/1992 | Valbjorn | |
| 5,460,008 | A * | 10/1995 | Ott et al. | 62/175 |

(Continued)

FOREIGN PATENT DOCUMENTS

| | | |
|---|---|---|
| EP | 0 410 330 A2 | 1/1991 |
| EP | 0 660 213 A2 | 5/1994 |
| EP | 1 139 037 A1 | 3/2001 |
| FR | 2 783 309 A1 | 3/2000 |
| GB | 2 180 673 | 4/1987 |

OTHER PUBLICATIONS

Snyder, Dick. "Suction pressure: how important is it?." Air Conditioning, Heating & Refrigeration News. BNP Media. 1992. HighBeam Research. <http://www.highbeam.com>.*

(Continued)

*Primary Examiner* — Cheryl J Tyler
*Assistant Examiner* — Paolo Gonzalez

(74) *Attorney, Agent, or Firm* — McCormick, Paulding & Huber LLP

(57) ABSTRACT

A method for controlling a refrigeration system with a variable compressor capacity, and at least two refrigeration entities, e.g. display cases, includes controlling suction pressure by either permitting or preventing the flow of refrigerant into the evaporators of one or more refrigeration entities. The method also includes controlling compressor capacity based on a signal derived from one or more properties of the one or more refrigeration entities, said signal reflecting a possible difference between the current compressor capacity and a current refrigeration demand of the refrigeration system. The method reduces wear on compressors by avoiding switching them ON or OFF to the largest extent possible, and also prevents problems relating to conflicting control strategies due to control parameters, e.g. suction pressure, being determined based on two or more controllable parts, e.g. compressors and flow of refrigerant into refrigeration entities.

12 Claims, 6 Drawing Sheets

U.S. PATENT DOCUMENTS

| | | | | |
|---|---|---|---|---|
| 5,533,347 | A * | 7/1996 | Ott et al. | 62/115 |
| 5,867,995 | A * | 2/1999 | Lewis | 62/115 |
| 6,378,315 | B1 * | 4/2002 | Gelber et al. | 62/80 |
| 6,449,968 | B1 * | 9/2002 | Singh et al. | 62/175 |
| 6,578,374 | B2 * | 6/2003 | Singh et al. | 62/200 |
| 7,207,184 | B2 * | 4/2007 | Jessen et al. | 62/175 |
| 2004/0016252 | A1 * | 1/2004 | Singh et al. | 62/224 |
| 2004/0123612 | A1 * | 7/2004 | Pham et al. | 62/228.3 |

OTHER PUBLICATIONS

PCT Search Report for Serial No. PCT/DK2006/000149 dated May 18, 2006.

Danish Search Report for Serial No. PA 2005 00411 dated Jan. 17, 2006.

* cited by examiner

METHOD FOR CONTROLLING A REFRIGERATION SYSTEM

CROSS REFERENCE TO RELATED APPLICATIONS

This application is entitled to the benefit of and incorporates by reference essential subject matter disclosed in International Patent Application No. PCT/DK2006/000149 filed on Mar. 15, 2006 and Danish Patent Application No. PA 2005 00411 filed Mar. 18, 2005.

FIELD OF THE INVENTION

The present invention relates to a method for controlling a refrigeration system having a compressor rack with a variable compressor capacity. The refrigeration system may advantageously be of the kind which is commonly used in supermarkets and having several display cases.

BACKGROUND OF THE INVENTION

Refrigeration systems as the one defined above normally comprise a compressor rack having variable capacity, a condenser and a number of refrigerated display cases. An example of such a refrigeration system is outlined in FIG. 1. Each display case is typically equipped with a control valve and an evaporator. The control valve serves as ON/OFF valve and as superheat control (expansion) valve and is typically a solenoid valve. When the control valve is a solenoid valve, the superheat is typically controlled by a pulse-width modulation approach. Alternatively, each display case may be equipped with an ON/OFF valve in combination with a thermostatic expansion valve.

The display cases of the refrigeration system are typically controlled according a hysteresis control strategy. In such a control strategy a representative temperature $T_{display}$ of a display case is measured. This temperature is compared with the predetermined upper, $T_{CutIn}$, and lower, $T_{CutOut}$, limits of a temperature band. When $T_{display}$ is equal to or higher than $T_{CutIn}$ the control valve is activated and starts controlling a flow of refrigerant into the evaporator while maintaining a sufficient superheat, thereby switching the evaporator from an inactive to an active state. By switching the evaporator to an active state, the case is refrigerated. The evaporator continues to be in the active state until the display temperature $T_{display}$ is equal to or lower than $T_{CutOut}$. When this is the case, the control valve is turned inactive, whereby it prevents the refrigerant from flowing into the evaporator until the display case temperature reaches $T_{CutIn}$. Using this control strategy the display case temperature is kept within the temperature band defined by $T_{CutIn}$ and $T_{CutOut}$ with minor over- and undershoots. The overshoots are generally small and they arise because there is a minor time delay from activating the control valve till the refrigerant is evaporated and the refrigeration starts affecting the display case temperature $T_{display}$. The undershoots are typically somewhat larger. They arise because the evaporator contains a certain amount of refrigerant (and because of the thermal capacity of the evaporator), when the control valve stops the flow of refrigerant into the evaporator. The temperature ($T_{display}$) will continue to drop until the refrigerant in the evaporator has evaporated, and until the temperature of the evaporator equals $T_{display}$.

When controlling the display cases according to a hysteresis control strategy, the case temperature $T_{display}$ cycles with a certain periodicity. Experience shows that the periodicity is nearly independent of the level of the temperature settings and the case type. Experience also shows that the cases tend to synchronize their temperature cycles so that they reach $T_{CutIn}$ almost at the same time, thereby causing the control valves to be activated almost simultaneously. Similarly, $T_{CutOut}$ is also reached by the cases at approximately the same time. This synchronization process is reflected in FIG. 2. This can be explained by the fact that the evaporators absorb more heat from the surrounding air when the suction pressure is relatively low than when the suction pressure is relatively high. Hence, when the majority of evaporators are inactive, thereby causing the suction pressure to be relatively low, the remaining active evaporators are able to drive the temperature down to $T_{CutOut}$ faster. Thereby the active evaporators will 'catch up' with the evaporators which are dominating the suction pressure, i.e. the slopes of the temperature curves corresponding to the active evaporators will become steeper. Since the control valves are turned active and inactive almost simultaneously, the synchronization process leads to a fluctuating suction pressure, and even a periodically fluctuating suction pressure.

The suction pressure is normally controlled via a compressor controller by increasing or lowering the number of compressors turned on or off. The compressor controller typically runs the compressors according to a Proportional Integral Derivative (PID) control strategy, often with a deadband compensation. The suction pressure is controlled on the basis of suction pressure measurements done with a pressure sensor at the inlet of the compressor rack. The synchronization initiated pressure fluctuations having the same periodicity as the case temperatures results in frequent turning compressors on and off with the same periodicity as the temperature fluctuations. This results in significant wear on the compressors, as they tend to follow the period of the display cases. The period of the display cases is typically in the order of minutes. This is a great disadvantage.

U.S. Pat. No. 5,460,008 describes a method of controlling a plurality of commonly piped compressors for a refrigeration system having a plurality of refrigeration cases. The method comprises the steps of sensing a suction pressure of the refrigeration system, determining whether the sensed suction pressure is within a predetermined pressure range, and turning compressors ON or OFF in stages until the suction pressure is within the predetermined pressure range. The method also includes the steps of sensing a case temperature for each of the refrigeration cases if the sensed suction pressure is within the predetermined pressure range and determining whether the sensed case temperature is within a predetermined temperature range. The method further includes the steps of turning selectively the load on each of the refrigeration cases ON or OFF when the case temperature is within the predetermined temperature range until the sensed suction pressure is within a predetermined synchronization pressure range.

Thus, in the method described in U.S. Pat. No. 5,460,008 the suction pressure is controlled partly by turning the load on the refrigeration cases ON or OFF, partly by turning the compressors ON or OFF.

EP 0 410 330 describes a method of operating a refrigeration installation, in particular a compound refrigeration installation having at least two compressors connected in parallel. A reference signal for the current cooling conditions at a cooling point is transmitted from each of a number of sensors to a central unit, which accordingly switches on or off the connected compressors. The measured values of temperature sensors as well as the respective coolant suction pressure are used as reference signal and are evaluated in the central unit. Thus, the compressor capacity is controlled on the basis of a measurement of the suction pressure.

However, it is a disadvantage of the method described in U.S. Pat. No. 5,460,008 and the method described in EP 0 410 330 that the load on the refrigeration cases as well as the compressor capacity are controlled on the basis of a measurement of the suction pressure, and that the object in both cases is to control the suction pressure to be within a desired pressure range. Thereby the same object is sought by controlling two different entities on the basis of the same control parameter. This introduces a risk that, in case the suction pressure approaches a limit of the desired range, the control system will attempt to counteract this by means of the refrigeration cases as well as by means of the compressors. The two manners of controlling may thereby either counteract each other or amplify each other, and the result may be that the suction pressure goes out of control. This is in particular a problem when the controlled variable, in this case the suction pressure, does not react instantaneously to a change of the control signal.

SUMMARY OF THE INVENTION

It is, thus, an object of the present invention to provide a method for controlling a refrigeration system having a compressor rack with a variable compressor capacity and two or more refrigeration entities, in such a way that the wear on the compressors is reduced as compared to the wear introduced by prior art control methods.

It is a further object of the present invention to provide a method for controlling a refrigeration system as defined above in such a way that each controllable part of the refrigeration system is controlled independently of any other controllable part of the refrigeration system.

According to a first aspect of the present invention, the above and other objects are fulfilled by providing a method for controlling a refrigeration system comprising a compressor rack having a variable compressor capacity, and at least two refrigeration entities, each having an evaporator being passed by a controllable flow of refrigerant, the method comprising the steps of:

- determining a suction pressure of the refrigeration system,
- controlling the suction pressure by permitting or preventing flow of refrigerant into the evaporator of one or more of the refrigeration entities, so as to maintain the suction pressure within a predetermined suction pressure range, and
- controlling the compressor capacity so as to match a desired capacity level, based on a signal derived from one or more properties of the one or more refrigeration entities, said signal reflecting a possible difference between the current compressor capacity and a current refrigeration demand of the refrigeration system.

According to a second aspect of the present invention, the above and other objects are fulfilled by providing a control system for controlling a refrigeration system comprising a compressor rack having a variable compressor capacity, and at least two refrigeration entities, each having an evaporator being passed by a controllable flow of refrigerant, the control system comprising:

- means for determining a suction pressure of the refrigeration system,
- means for controlling the suction pressure by permitting or preventing flow of refrigerant into the evaporator of one or more of the refrigeration entities, so as to maintain the suction pressure within a predetermined suction pressure range, and
- means for controlling the compressor capacity so as to match a desired capacity level, based on a signal derived from one or more properties of the one or more refrigeration entities, said signal reflecting a possible difference between the current compressor capacity and a current refrigeration demand of the refrigeration system.

The control system according to the second aspect of the invention may advantageously form part of a refrigeration system.

In the present context the term 'refrigeration entity' should be interpreted to mean a location where refrigeration of products takes place. Thus, a refrigeration entity may be a display case, e.g. the kind which is normally used in a supermarket. The display cases may be open display cases or the kind having a door which the customer needs to open in order to gain access to the products being refrigerated. Alternatively, a refrigeration entity may be a larger entity, such as a closed refrigeration room, e.g. the kind which may be used in restaurants or a slaughterhouse. The refrigeration system may comprise refrigeration entities of various kinds, e.g. two or more of the kinds described above. Alternatively, the refrigeration system may comprise only one kind of refrigeration entities.

The flow of refrigerant passing each of the evaporators of the refrigeration entities is preferably controlled by means of one or more valves. The flow of refrigerant passing a specific evaporator may, thus, be controlled by means of one electronic valve being capable of controlling the flow of refrigerant in such a way that the temperature of the refrigeration entity in question is maintained within a desired temperature range, and in such a way that the suction pressure is maintained within a desired pressure range. Alternatively, the flow of refrigerant passing a specific evaporator may be controlled by means of two or more valves, e.g. a thermostatic expansion valve being capable of controlling filling, and an electronic valve (positioned in series with the thermostatic expansion valve) being capable of opening and closing the flow of refrigerant in such a way that the temperature is maintained within a desired temperature range.

In the present context the term 'suction pressure' is to be interpreted to mean a pressure of the refrigerant immediately upstream in relation to the compressor rack. The suction pressure is preferably measured by means of a probe positioned in an appropriate location. This pressure is determined by the amount of refrigerant being compressed by the compressors of the compressor rack and by the amount of refrigerant passing the evaporators of the refrigeration entities. Thus, the suction pressure is determined, on one hand, by the consumption of refrigerant by the compressors, and, on the other hand, by the production of refrigerant by the refrigeration entities, as seen from the position of the probe. According to the present invention the suction pressure is controlled to be maintained within a predetermined suction pressure range by permitting or preventing flow of refrigerant into the evaporators. Thus, even though the capacity of the compressors is still influencing the suction pressure, the suction pressure is controlled solely by controlling the amount of refrigerant passing the evaporators, i.e. not the amount of refrigerant being compressed by the compressors of the compressor rack. Thereby the suction pressure is only controlled using one control parameter, and no conflicting control strategies will therefore occur.

The compressor capacity, on the other hand, is controlled so as to match a desired capacity level. This is to ensure that the supply of refrigerant to the refrigeration entities actually meets the refrigeration demand over a longer period of time. If the supply does not match the demand, the supply should be adjusted by adjusting the compressor capacity, i.e. by switching a compressor ON or OFF. The compressor capacity is controlled on the basis of a signal derived from one or more properties of the one or more refrigeration entities. The signal reflects a possible difference between the current compressor capacity and a current refrigeration demand of the refrigeration system. Thus, the compressor capacity is controlled on the basis of the refrigeration demand of the refrigeration system, and not on the basis of the measured suction pressure. Thereby it is avoided that the control strategies conflict.

The signal may be derived from an average temperature of the at least two refrigeration entities. In this case the refrigeration demand of the refrigeration system is expressed in terms of an average temperature of at least some of the refrigeration entities. If the supply of refrigerant does not match the refrigeration demand of the refrigeration system, the average temperature of the refrigeration entities will most likely change. In case the supply is too large, the average temperature will decrease, and in case the supply is insufficient, the average temperature will increase. The average temperature may be derived from the temperature of all the refrigeration entities of the refrigeration system. Alternatively, it may be derived from some of the refrigeration entities, e.g. some refrigeration entities which are representative for the refrigeration entities of the refrigeration system.

Alternatively or additionally, the signal may be derived from a change in refrigeration demand of the refrigeration system during a specific time period. The change in refrigeration demand may advantageously be determined by the number of refrigeration entities to which a flow of refrigerant into the evaporator has been permitted and the number of refrigeration entities to which a flow of refrigerant into the evaporator has been prevented during the specific time period. In this case the change in refrigeration demand may be determined by means of the difference between the number of refrigeration entities having been switched ON/active during the specific time period, and the number of refrigeration entities having been switched OFF/inactive during the same time period. If the supply of refrigerant matches the refrigeration demand of the refrigeration system, there will be no difference between these two numbers. But in case the supply of refrigerant does not match the refrigeration demand, one of the numbers will be larger than the other, and an adjustment of the compressor capacity will be needed. Alternatively or additionally, the change in refrigeration demand may be determined on the basis of a change in the set point, a change in the outdoor temperature, and/or on the basis of any other suitable parameter.

The step of controlling the suction pressure is preferably performed in such a way that each refrigeration entity maintains a temperature within a predetermined temperature range. Thereby it is ensured that none of the refrigeration entities will be controlled to have a temperature which is outside an acceptable range of temperatures.

The predetermined temperature range may be defined individually for each refrigeration entity, e.g. in accordance with the kind of products being refrigerated in the refrigeration entities.

The step of controlling the suction pressure may comprise selecting a refrigeration entity and permitting or preventing flow of refrigerant into the evaporator of the selected refrigeration entity. In this case the suction pressure may be controlled to be higher by permitting flow of refrigerant into the evaporator of a refrigeration entity in which such a flow was previously prevented (i.e. the refrigeration entity in question is turned ON/active). Similarly, the suction pressure may be controlled to be lower by preventing flow of refrigerant into the evaporator of a refrigeration entity in which such a flow was previously permitted (i.e. the refrigeration entity in question is turned OFF/inactive).

Thus, the step of controlling the suction pressure, in case the suction pressure approaches an upper limit of the predetermined suction pressure range, may comprise the steps of:

selecting a refrigeration entity having an evaporator into which a flow of refrigerant is currently permitted and having a temperature which is within the predetermined temperature range for that refrigeration entity, and preventing a flow of refrigerant into the evaporator of the selected refrigeration entity.

The refrigeration entity may be selected among the refrigeration entities fulfilling the criteria given above according to various parameters. For example, the selected refrigeration entity may advantageously have a temperature which is at or near the lower limit of the predetermined temperature range ($T_{CutOut}$). Such a refrigeration entity will need to be turned OFF/inactive shortly anyway in order to maintain the temperature within the predetermined temperature range. So in effect the refrigeration entity in question is merely turned OFF/inactive a little bit earlier than necessary, and thereby the suction pressure is controlled. In case two or more refrigeration entities have temperatures being at or near the lower limit of the predetermined temperature range ($T_{CutOut}$), the refrigeration entity having a temperature which is closest to the lower limit may advantageously be selected. The term 'closest' could in this context be understood in the sense 'fewest degrees away from'. However, in most cases, and in particular if the refrigeration entities have temperature ranges of various sizes, it would be more appropriate to define 'closest' in terms of 'relative distance', i.e. the refrigeration entity being closest to the lower limit is the one which, relatively to the size of its temperature range, is closest to the lower limit. Thus, if two refrigeration entities have temperatures which are 1° C. away from the lower limit of their respective temperature ranges, but one has a temperature range which is substantially larger than the other one, the one with the larger temperature range would be relatively closer to the lower limit, and this refrigeration entity would therefore be selected in this example. It is an advantage of this particular embodiment of the present invention that this manner of selecting the refrigeration entity considerably reduces the synchronisation between the refrigeration entities which has been described above. Thereby the wear on the compressors is even further reduced.

Alternatively or additionally, the step of controlling the suction pressure, in case the suction pressure approaches a lower limit of the predetermined suction pressure range, may comprise the steps of:

selecting a refrigeration entity having an evaporator into which a flow of refrigerant is currently prevented and having a temperature which is within the predetermined temperature range for that refrigeration entity, and permitting a flow of refrigerant into the evaporator of the selected refrigeration entity.

This is very similar to the situation described above. However, in this case the selected refrigeration entity may advantageously have a temperature which is at or near the upper limit of the predetermined temperature range ($T_{CutIn}$). Such a refrigeration entity will need to be turned ON/active shortly anyway in order to maintain the temperature within the predetermined temperature range. So, similarly to what is described above, the refrigeration entity is merely turned ON/active a bit earlier than necessary, and thereby the suction pressure is controlled. In case two or more refrigeration entities have temperatures being at or near the upper limit of the predetermined temperature range ($T_{CutIn}$), the refrigeration entity having a temperature which is closest to the upper limit may advantageously be selected. The remarks regarding the term 'closest' set forth above are equally applicable here. Furthermore, this embodiment even further reduces the problems arising from synchronisation of the refrigeration entities.

The method may further comprise the step of shifting the upper limit of the predetermined suction pressure range to a higher value by an amount $\Delta P_U$ after having prevented a flow of refrigerant through a refrigeration entity, wherein $\Delta P_U$ approaches zero during a time interval following the shifting of the limit.

When preventing a flow of refrigerant through a refrigeration entity it will normally take a while before the effect can be seen in the suction pressure. This is because an amount of refrigerant will be present in the evaporator of the refrigeration entity at the moment when the flow is prevented. Until this amount of refrigerant has been evaporated the evaporator will continue to produce refrigerant, thereby increasing the suction pressure. In order to avoid that a flow of refrigerant through another refrigeration entity is prevented before the effect of preventing a flow through the previous one can be seen, the suction pressure is temporarily allowed to exceed the upper limit of the predetermined pressure range. This is done by shifting the upper limit as described above, and by letting $\Delta P_U$ approach zero in an appropriate manner and over an appropriate time.

Alternatively or additionally, the method may further comprise the step of shifting the lower limit of the predetermined suction pressure range to a lower value by an amount $\Delta P_L$ after having permitted a flow of refrigerant through a refrigeration entity, wherein $\Delta P_L$ approaches zero during a time interval following the shifting of the limit.

This is very similar to the situation described above. Only, in this case it will take a while before the effect of permitting a flow of refrigerant into the evaporator of a refrigeration entity can be seen, because it will take a while before the permitted flow is actually evaporated, thereby creating an increase in the suction pressure.

BRIEF DESCRIPTION OF THE DRAWINGS

The invention will now be described in further details with reference to the accompanying drawings, in which.

DETAILED DESCRIPTION OF THE INVENTION

Figure 1:
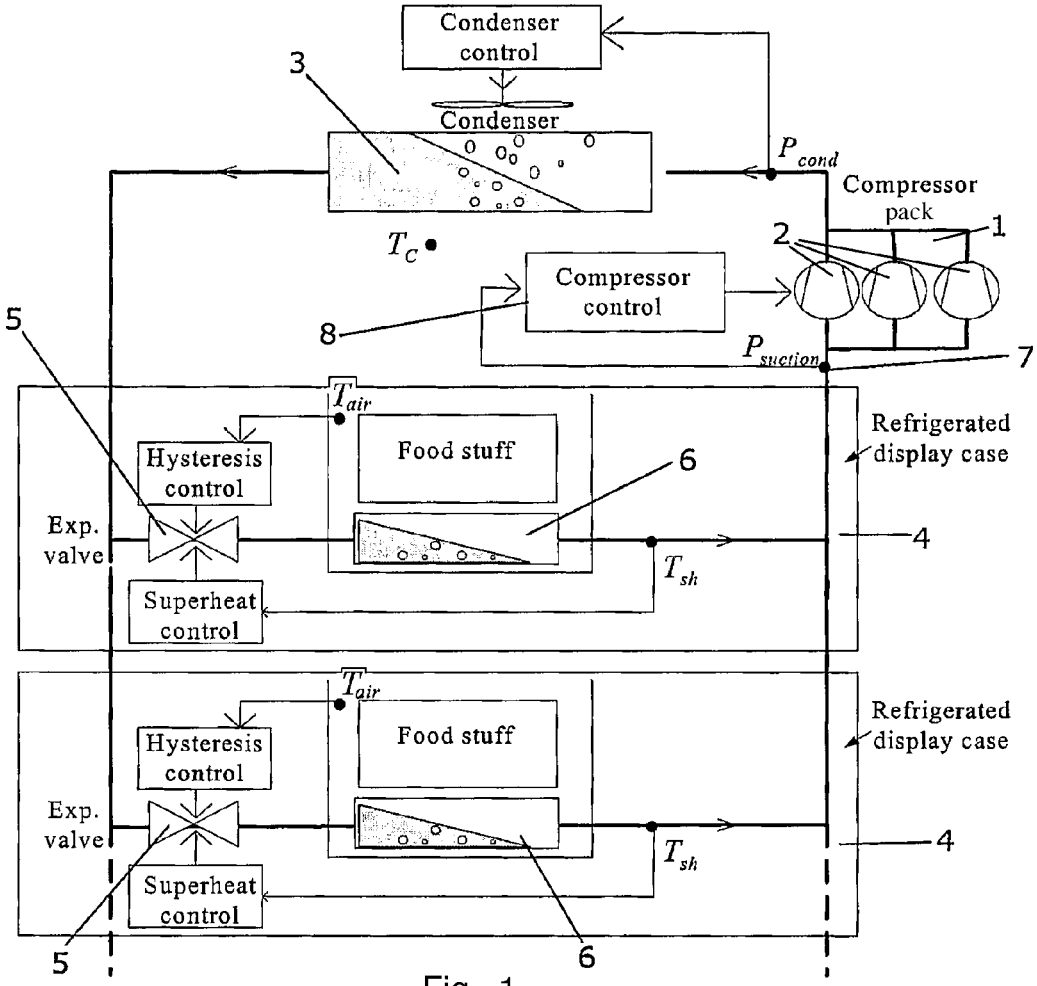
Fig. 1 Prior Art
FIG. 1 is a schematic drawing of a refrigeration system comprising a compressor rack having a variable compressor capacity, and a number of refrigeration entities.

FIG. 1 is a schematic drawing of a refrigeration system comprising a compressor rack 1 having three compressors 2. The refrigeration system shown in FIG. 1 is controlled by means of a prior art control method. The refrigeration system further comprises a condenser 3 and a number of refrigeration entities 4 coupled in parallel. Two refrigeration entities 4 are shown in the Figure, but the refrigeration system may comprise more refrigeration entities 4. Each refrigeration entity 4 comprises a solenoid valve 5 serving as expansion valve and ON/OFF valve, and an evaporator 6. The solenoid valve 5 ensures that the temperature in the corresponding refrigeration entity 4 is maintained within a desired temperature range, while maintaining an optimum filling of the evaporators.

A probe 7 for measuring the suction pressure is positioned immediately upstream in relation to the compressor rack 1. The probe 7 produces an input to a compressor controller 8 which is adapted to control the compressor rack 1 in response to the input. Thus, the suction pressure is controlled to be within a desired pressure range by means of switching ON or OFF the compressors 2 of the compressor rack 1.

Figure 2:
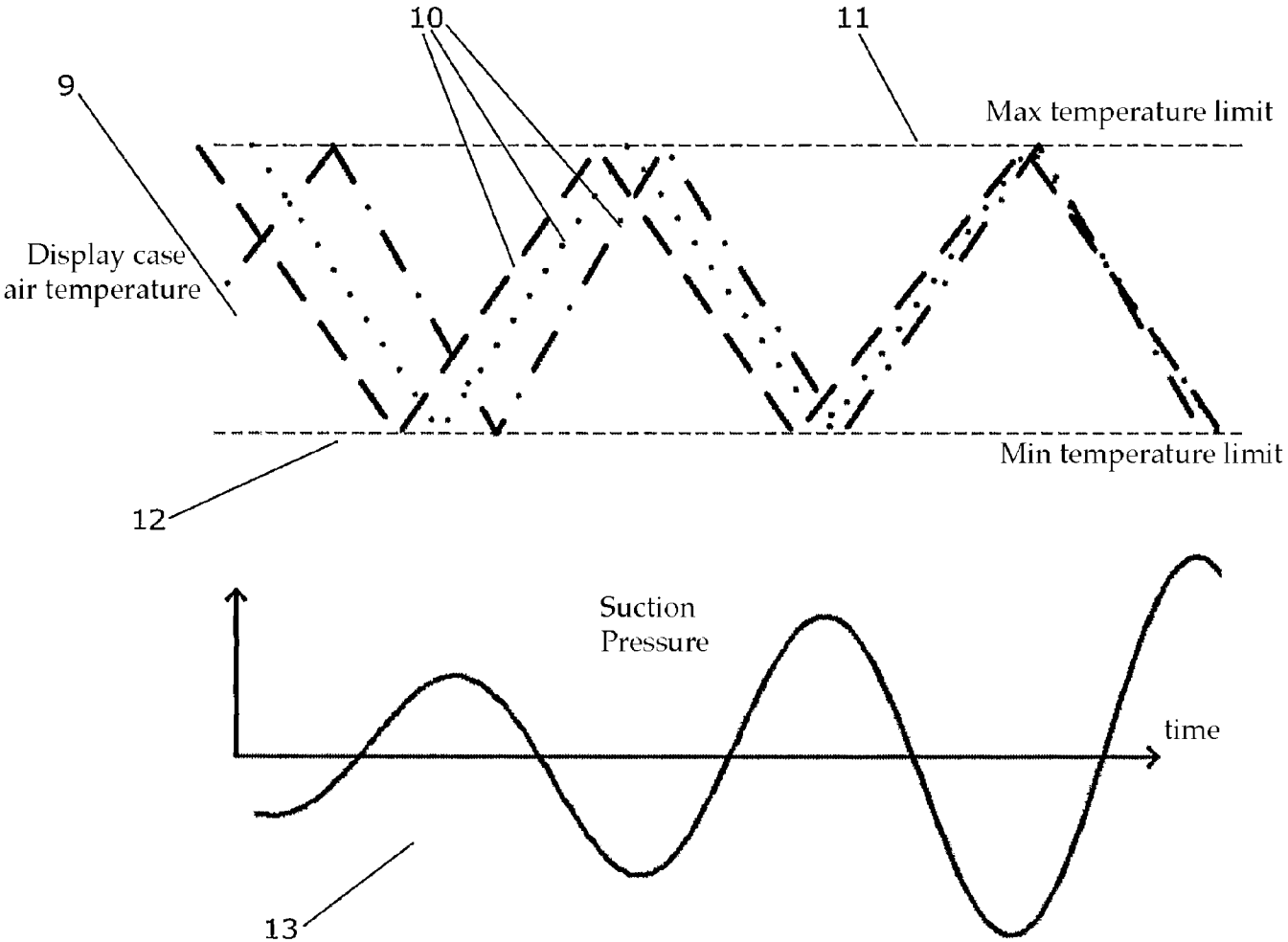
Fig. 2 Prior Art
FIG. 2 shows variations in temperature for three refrigeration entities and the corresponding variations in the suction pressure.

FIG. 2 shows two graphs which illustrate variations in temperature, $T_{display}$, and suction pressure in a refrigeration system which is controlled in accordance with a prior art control method. One of the graphs 9 illustrates variations in the temperature, $T_{display}$, of three different refrigeration entities. Each refrigeration entity is represented by a curve 10. As can be seen, $T_{display}$ for each refrigeration entity is allowed to vary within a temperature range defined by an upper value 11 and a lower value 12. When $T_{display}$ for a refrigeration entity reaches the upper limit 11 of the temperature range the solenoid valve 5 corresponding to that refrigeration entity will open, thereby allowing a flow of refrigerant to pass the evaporator of the refrigeration entity. See FIG. 1 for details. The refrigeration entity will accordingly start refrigerating, thereby causing $T_{display}$ to decrease. Similarly, when $T_{display}$ for a refrigeration entity reaches the lower limit 12 of the temperature interval, the corresponding solenoid valve 5 will shut, thereby preventing a flow of refrigerant from passing the corresponding evaporator. Similarly to what is described above, this will cause $T_{display}$ to increase for the corresponding refrigeration entity.

However, for each refrigeration entity the slope of the temperature curve 10 is influenced by the capacity of the corresponding evaporator. This has already been explained above. This has the effect that over time the refrigeration entities tend to 'synchronize' in such a way that they all reach the upper limit 11 and the lower limit 12 of the temperature range approximately simultaneously. This effect can be seen in FIG. 2. The effect is very undesirable because when substantially all the refrigeration entities reach the upper limit 11 of the temperature range approximately simultaneous, they will all start needing to receive a flow of refrigerant approximately simultaneous, thereby increasing the refrigeration demand of the refrigeration system dramatically. In order to meet this increase in refrigeration demand it will be necessary to switch ON one or more compressors of the compressor rack. Similarly, when substantially all the refrigeration entities reach the lower limit 12 of the temperature range approximately simultaneous, the refrigeration demand of the refrigeration system will decrease dramatically. Accordingly, it will be necessary to switch OFF one or more compressors of the compressor rack. Ultimately, this situation may lead to simultaneous switching ON and OFF of all the compressors in the compressor rack when all the refrigeration entities reach the limits of the temperature range. This will increase the wear on the compressors and is therefore highly undesirable.

Furthermore, as can be seen from the other graph 13 the situation described above will also lead to relatively large periodical and undesirable variations in the suction pressure.

Figure 3:
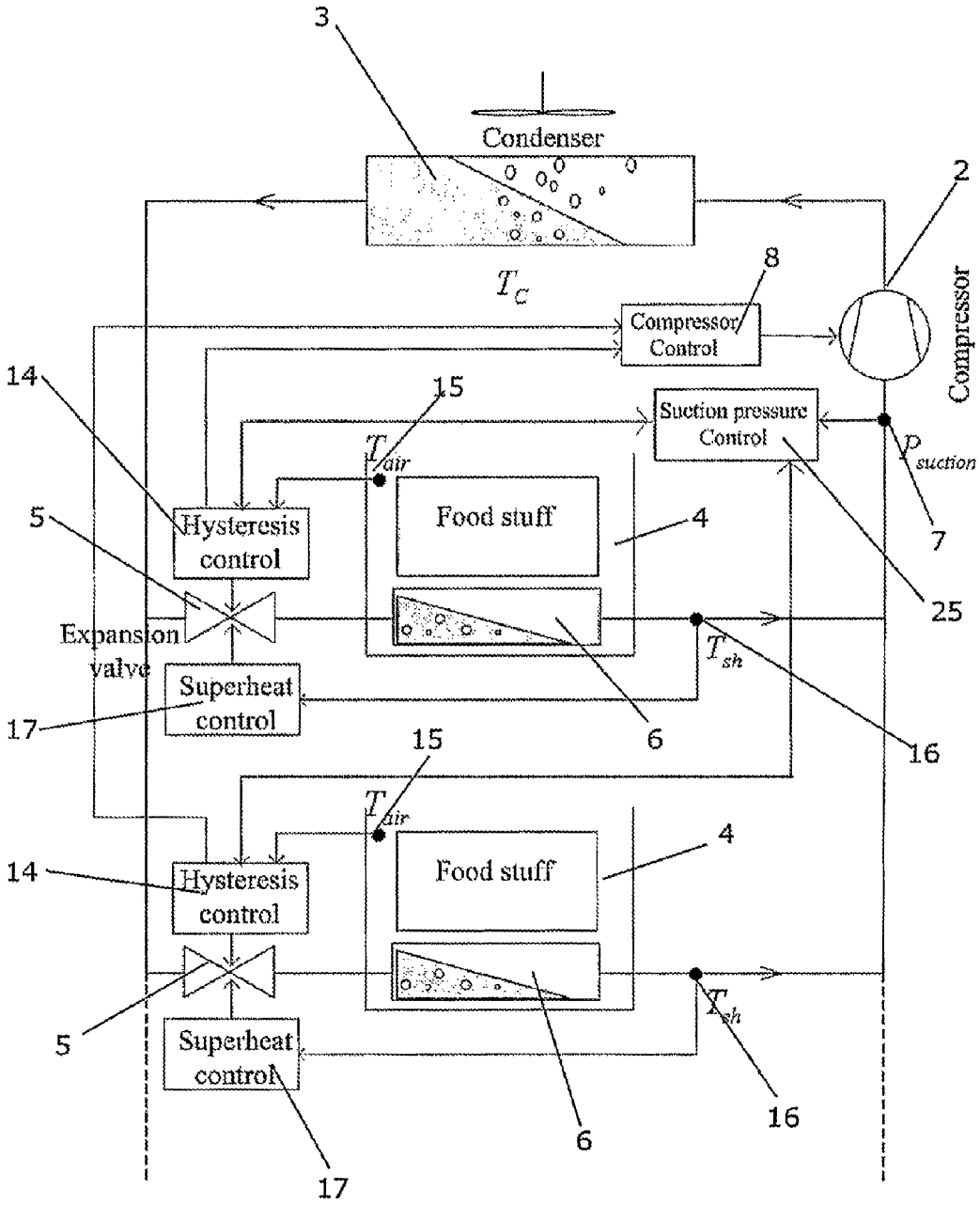
FIG. 3 is a schematic drawing illustrating a control system for a refrigeration system according to an embodiment of the present invention.

FIG. 3 shows a refrigeration system which is controlled in accordance with a control method of the present invention. FIG. 3 shows two refrigeration entities 4, but it should be understood that the refrigeration system could comprise further refrigeration entities. The refrigeration system has one or more compressors 2, e.g. arranged in a compressor rack like the one shown in FIG. 1.

In FIG. 3 there is shown a compressor 2 which is fluidly connected to a condenser unit 3 which is in turn fluidly connected to the refrigeration entities 4. The compressor 2 has a variable compressor capacity and is preferably in the form of a compressor rack like the one shown in FIG. 1. The refrigeration entities 4 each comprises a solenoid valve 5 serving as expansion valve and ON/OFF valve, an evaporator 6, a superheat sensor 16, and a superheat controller 17. The superheat sensor 16 measures the difference between the evaporating temperature and the temperature in the outlet of the evaporator 6. This is typically done by measuring the suction pressure, converting that to an evaporating temperature and subtracting this from a measured outlet temperature. It can alternatively be achieved by measuring the temperature in the inlet and outlet of the evaporator 6 and producing the difference. The objective of the superheat controller 17 is to maximize the liquid filled part of the evaporator 6, while not allowing liquid refrigerant to exit the evaporator 6. The superheat control 17 achieves that by adjusting the valve 5 to obtain a small, but positive, superheat. By doing that it utilizes that the temperature profile in the evaporator 6 is substantially constant in the liquid filled region and is increasing in the dry region. Hence, a positive superheat temperature ensures that no liquid refrigerant leaves the evaporator 6. By keeping said superheat temperature low the liquid region is maximized. This superheat function is incorporated in the design of the thermostatic type of expansion valves.

The refrigeration system further comprises a probe 7 for measuring the suction pressure. The probe 7 is positioned immediately upstream in relation to the compressor 2. The probe 7 produces an output which is fed into a central suction pressure control unit 25. Based on the output the central pressure control unit 25 produces control signals which are fed into hysteresis controls 14 of the refrigeration entities 4. Each of the refrigeration entities 4 also comprises a temperature probe 15 for measuring the temperature of the air present in the refrigeration entity 4. The measured temperature is also fed into the hysteresis control 14 of the corresponding refrigeration entity 4.

In a preferred embodiment the refrigeration system shown in FIG. 3 is controlled in the following manner. When the central suction pressure control unit 25 receives the output from the probe 7, it investigates whether or not the measured suction pressure is within a desired range. If this is not the case, or if the suction pressure is approaching an upper or a lower limit of a desired range, the central suction pressure control unit 25 selects a refrigeration entity 4 which is to be switched ON/active or OFF/inactive, depending on whether the suction pressure is too low or too high. The selection is preferably done in the following manner. In case the suction pressure is too low there is a need to switch a refrigeration entity 4 ON/active in order to increase the suction pressure. The refrigeration entity 4 should therefore be selected among the refrigeration entities 4 which are currently OFF/inactive. If this is the case for more than one refrigeration entity 4, a refrigeration entity 4 having a temperature which is at or near an upper temperature limit should be selected, since such a refrigeration entity 4 will have to be switched ON/active shortly anyway. In case two or more refrigeration entities 4 fulfil this criterion, the one being closest to the limit should be selected. The term 'closest' in this context has been defined previously. In case the suction pressure is too high there is a need to switch a refrigeration entity 4 OFF/inactive. The selection procedure will in this case be very similar to the one described above, except the refrigeration entity 4 should be selected among the refrigeration entities 4 which are currently ON/active, preferably having a temperature being at or near a lower temperature limit, etc.

Thus, the solenoid valve 5, and thereby the flow of refrigerant into the evaporator 6, is controlled in such a way that the temperature of the refrigeration entity 4 is maintained within a desired temperature range and in such a way that the suction pressure is maintained within a desired pressure range. In other words, the suction pressure is controlled by switching refrigeration entities 4 ON/active or OFF/inactive. Thereby wear on the compressor 2 is avoided to the greatest extent possible.

The hysteresis control 14 of each refrigeration entity 4 furthermore produces an input to the compressor controller 8. This input is based on one or more properties of the corresponding refrigeration entity 4, e.g. a temperature value or the number of times the refrigeration entity 4 in question has been switched ON/active and/or OFF/inactive during a specific time interval. Based on these inputs the compressor controller 8 can derive one or more parameters, e.g. an average temperature of one or more refrigeration entities 4 and/or the difference between the number of refrigeration entities which has been switched ON/active and the number of refrigeration entities which has been switched OFF/inactive during a specific time interval. Thus, the compressor 2 is controlled on the basis of one or more parameters relating to the refrigeration entities 4, i.e. the compressor 2 is controlled in such a way that the refrigeration demand of the refrigeration system is met.

Alternatively, the central suction pressure control unit 25 may communicate information directly to the compressor controller 8. Such information may, e.g., comprise information relating to how many refrigeration entities have been switched ON/active and/or OFF/inactive during a specific time interval.

Figure 4:
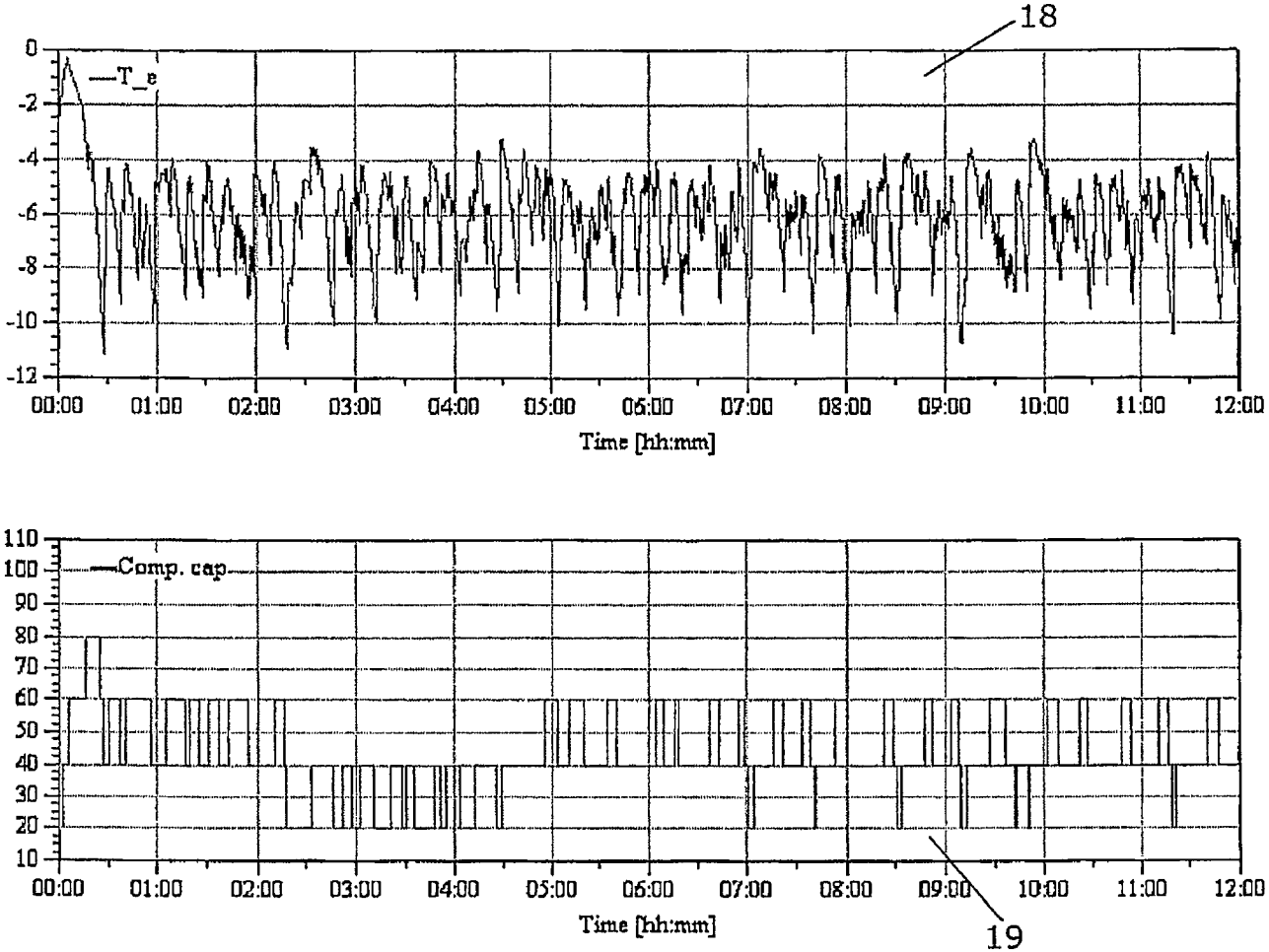
Fig. 4 Prior Art
FIG. 4 shows a simulation of variations in evaporating temperature and compressor capacity for a refrigeration system being controlled using a prior art control method.

FIG. 4 shows two graphs illustrating a prior art control method. The upper graph 18 shows variations in evaporating temperature as a function of time in a refrigeration system which is controlled in accordance with a prior art control method. As can be seen the temperature varies relatively much, but is maintained substantially within a specific range of temperatures.

The lower graph 19 shows the compressor capacity as a function of time of the same refrigeration system and during the same time interval. Each change in compressor capacity corresponds to a compressor being switched ON or OFF. As can be seen from the graph 19 compressors are switched ON or OFF relatively often in order to maintain the evaporating temperature within the specific temperature range. This causes a lot of wear on the compressors.

Figure 5:
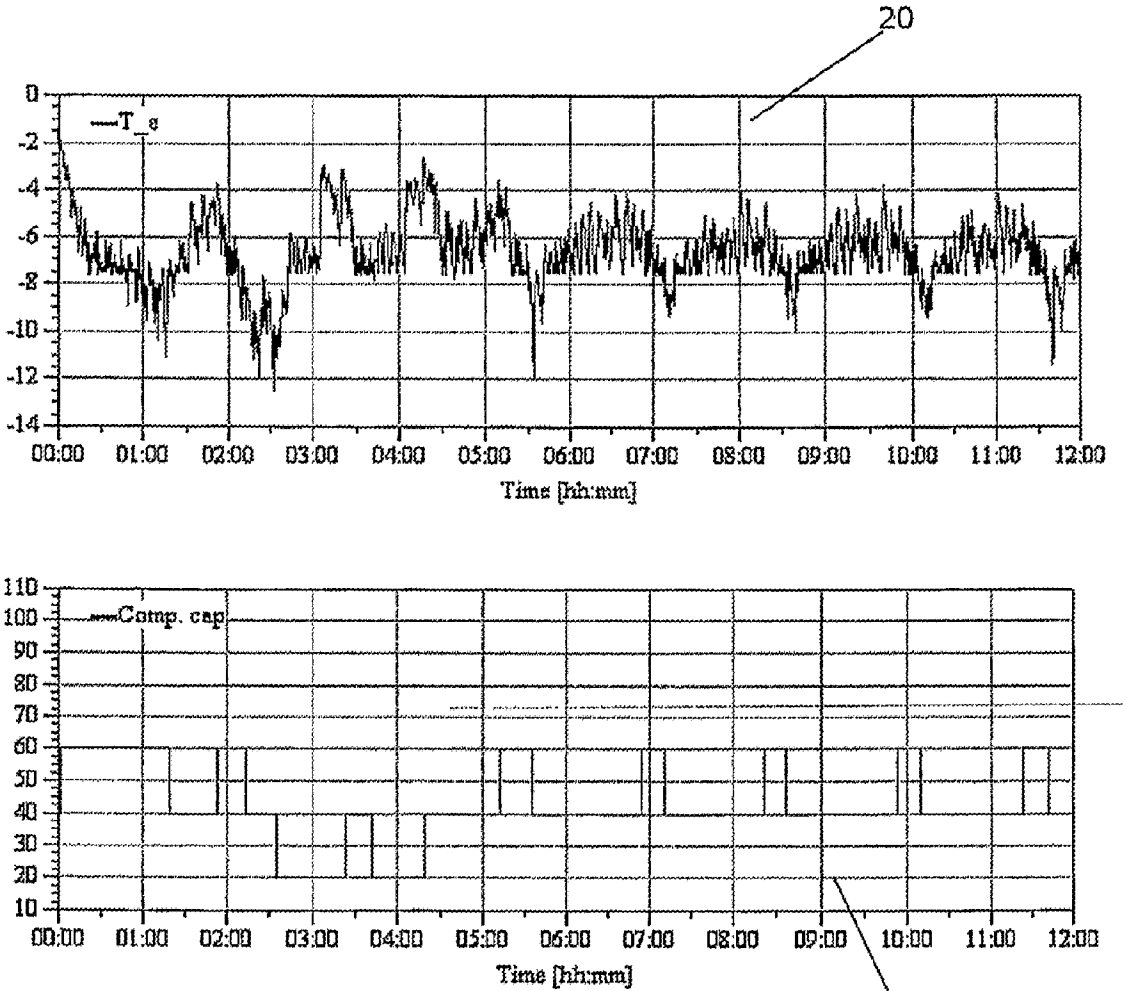
FIG. 5 shows a simulation of variations in evaporating temperature and compressor capacity for a refrigeration system being controlled using a control method according to an embodiment of the present invention.

FIG. 5 corresponds to FIG. 4, but in this case the two graphs illustrate a control method in accordance with the present invention. The temperature variations shown in the upper graph 20 are smaller than the temperature variations shown in the upper graph 18 of FIG. 4. Thus, the evaporating temperature is maintained more stable when using a control method according to the present invention. More importantly, the lower graph 21 shows that the variations in compressor capacity are much smaller than the variations in compressor capacity shown in the lower graph 19 of FIG. 4. Thus, the compressors of the compressor rack are switched ON or OFF less frequently when using a control method according to the present invention than when using a prior art control method. Thereby the wear on the compressors is considerably reduced.

Figure 6:
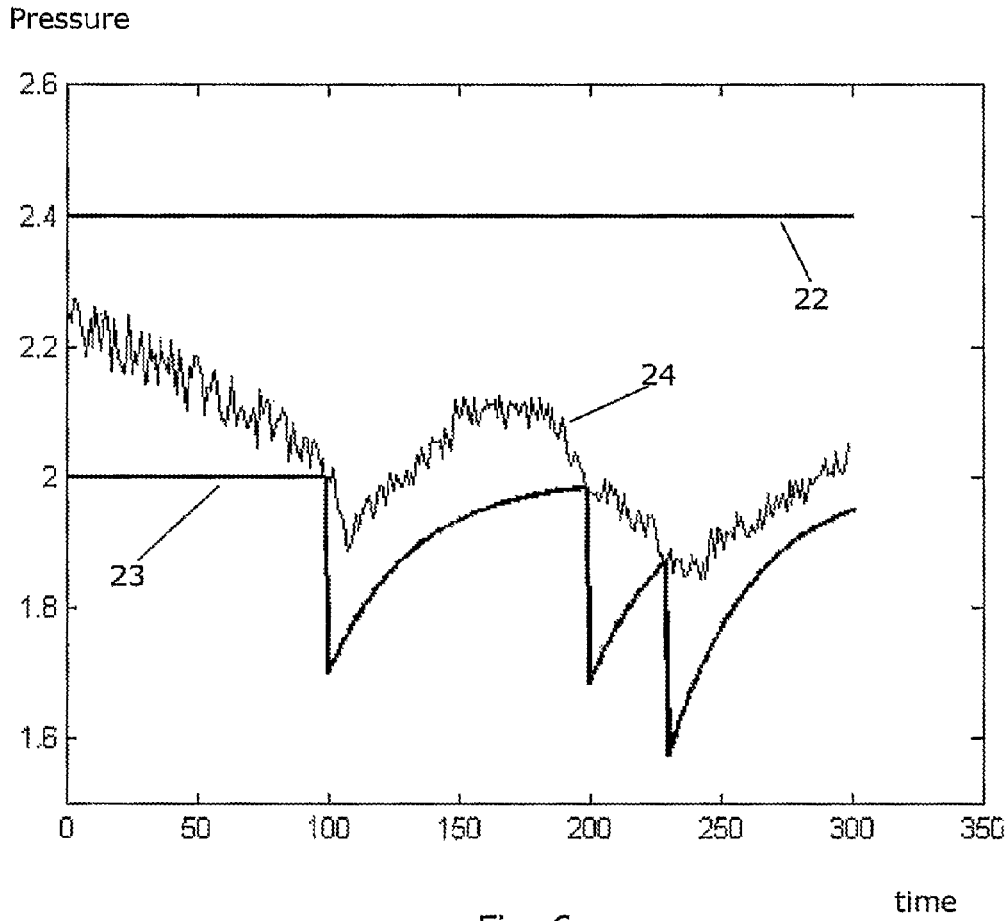
FIG. 6 shows shifting of a lower limit of the predetermined pressure range after a flow of refrigerant has been permitted through the evaporator of a refrigeration entity.

FIG. 6 shows a pressure range within which the suction pressure is allowed to vary according to a control method of the present invention. The Figure shows an upper limit 22 which is substantially fixed and a lower limit 23 which is being shifted to a lower value if certain conditions are fulfilled. This will be described further below. Finally, the Figure shows the suction pressure 24 as a function of time.

As can be seen from FIG. 6, the suction pressure 24 decreases from an initial value which is well above the lower limit 23, thereby approaching the lower limit 23. In order to prevent the suction pressure 24 from dropping below the lower limit 23 a refrigeration entity is switched ON/active, i.e. a flow of refrigerant is allowed to pass the evaporator of the refrigeration entity. However, it will take a while before the effect of this act will be detectable, because it will take a while before the flow of refrigerant being permitted into the evaporator will actually evaporate, thereby causing an increase in the suction pressure. Thus, the suction pressure 24 will continue to decrease for a while, and there is therefore a risk that the lower limit 23 will be passed, even though steps have already been taken to prevent the continuing decrease in the suction pressure 24. In order to prevent that another refrigeration entity is switched ON/active before the effect of switching ON/active the previous one can be detected, the lower limit 23 is temporarily shifted to a lower value when a refrigeration entity is switched ON/active. As can be seen, the suction pressure 24 is thereby allowed to decrease below the original lower limit 23.

Subsequently the lower limit 23 approaches the original lower limit 23 in an appropriate manner which on the one hand ensures that due consideration is shown to the situation described above and, on the other hand, it is ensured that the suction pressure 24 is not allowed to decrease to an unacceptable level.

As the suction pressure 24 at a later point in time again approaches the lower limit 23, the procedure described above is repeated. However, as can be seen, in this case it is not sufficient to switch ON/active a single refrigeration entity, because even though the lower limit 23 is shifted to a lower value, the suction pressure 24 still approaches the new (lower) limit, and it is therefore necessary to switch ON/active another refrigeration entity before the lower limit 23 has reached the original level. In order to allow the effect of the last refrigeration entity being switched ON/active to be detectable, the lower limit 23 is once again shifted to a lower value by the same amount, thereby allowing the suction pressure 24 to drop to an even lower value before another refrigeration entity is switched ON/active.

It should be understood that the description given above would equally apply in case the suction pressure 24 approaches the upper limit 22 of the pressure range. However, in this case the upper limit 24 will be temporarily shifted to a higher level when a refrigeration entity is switched OFF/inactive in order to cause a decrease in the suction pressure 24.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method for controlling a refrigeration system comprising a compressor rack having a variable compressor capacity, at least two refrigeration entities, each having an evaporator being passed by an individually controllable flow of refrigerant, and a pressure control unit, the method comprising the steps of:

determining a suction pressure of the refrigeration system, controlling the suction pressure by individually permitting or preventing flow of refrigerant into the evaporator of one or more of the refrigeration entities in response to a control signal from the pressure control unit, so as to maintain the suction pressure within a predetermined suction pressure range, and controlling the compressor capacity so as to match a desired capacity level, based on a signal derived from an average temperature of the at least two refrigeration entities and from a change in refrigeration demand of the refrigeration system determined by the difference between the number of refrigeration entities to which a flow of refrigerant into the evaporator has been individually permitted and the number of refrigeration entities to which a flow of refrigerant into the evaporator has been individually prevented during a specific time period, wherein the step of controlling the suction pressure is performed in such a way that each refrigeration entity maintains a temperature within a predetermined temperature range, and wherein the predetermined temperature range is defined individually for each refrigeration entity.

2. The method according to claim 1, wherein the step of controlling the suction pressure comprises selecting a refrigeration entity using the pressure control unit and permitting or preventing flow of refrigerant into the evaporator of the selected refrigeration entity in response to the control signal from the pressure control unit.

3. The method according to claim 1, wherein the step of controlling the suction pressure, in case the suction pressure approaches an upper limit of the predetermined suction pressure range, comprises the steps of:

selecting a refrigeration entity having an evaporator into which a flow of refrigerant is currently permitted and having a temperature which is within the predetermined temperature range for that refrigeration entity, and individually preventing a flow of refrigerant into the evaporator of the selected refrigeration entity, wherein the selected refrigeration entity is selected by the pressure control unit.

4. The method according to claim 3, wherein the selected refrigeration entity has the temperature that is closest to a lower limit of the predetermined temperature range of that refrigeration entity.

5. The method according to claim 3, wherein the step of individually preventing the flow of refrigerant comprises:

transmitting a control signal from the pressure control unit to the selected refrigeration entity, and shutting a solenoid valve to secure the flow of refrigerant to the evaporator of the selected refrigeration entity in response to the control signal.

6. The method according to claim 1, wherein the step of controlling the suction pressure, in case the suction pressure approaches a lower limit of the predetermined suction pressure range, comprises the steps of:

selecting a refrigeration entity having an evaporator into which a flow of refrigerant is currently prevented and having a temperature which is within the predetermined temperature range for that refrigeration entity, and individually permitting a flow of refrigerant into the evaporator of the selected refrigeration entity, wherein the selected refrigeration entity is selected by the pressure control unit.

7. The method according to claim 1, further comprising the step of shifting a lower limit of the predetermined suction pressure range to a lower value by an amount $\Delta P_L$ after having permitted a flow of refrigerant through a refrigeration entity, wherein $\Delta P_L$ approaches zero during a time interval following the shifting of the limit lower.

8. The method according to claim 6, wherein the selected refrigeration entity has the temperature that is closest to an upper limit of the predetermined temperature range of that refrigeration entity.

9. The method according to claim 6, wherein the step of individually permitting the flow of refrigerant comprises:

transmitting a control signal from the pressure control unit to the selected refrigeration entity, and opening a solenoid valve to initiate the flow of refrigerant to the evaporator of the selected refrigeration entity in response to the control signal.

10. The method according to claim 1, further comprising the step of shifting an upper limit of the predetermined suction pressure range to a higher value by an amount $\Delta P_U$ after having prevented a flow of refrigerant through a refrigeration entity, wherein $\Delta P_U$ approaches zero during a time interval following the shifting of the upper limit.

11. A control system for controlling a refrigeration system comprising a compressor rack having a variable compressor capacity, at least two refrigeration entities, each having an evaporator being passed by a controllable flow of refrigerant, and a pressure control unit, the control system comprising:

means for determining a suction pressure of the refrigeration system, means for controlling the suction pressure by individually permitting or preventing flow of refrigerant into the evaporator of one or more of the refrigeration entities in response to a control signal from the pressure control unit, so as to maintain the suction pressure within a predetermined suction pressure range, and means for controlling the compressor capacity so as to match a desired capacity level, based on a signal derived from an average temperature of the at least two refrigeration entities and from a change in refrigeration demand of the refrigeration system determined by the difference between the number of refrigeration entities to which a flow of refrigerant into the evaporator has been permitted and the number of refrigeration entities to which a flow of refrigerant into the evaporator has been prevented during a specific time period, wherein the means for controlling the suction pressure is adapted to maintain a temperature of each refrigeration entity within a predetermined temperature range, and wherein the predetermined temperature range is defined individually for each refrigeration entity.

12. A refrigeration system comprising a control system according to claim 11.

* * * * *